United States Patent [19]

Fusco

[11] 4,118,964

[45] Oct. 10, 1978

[54] LUBRICATED MANDREL FOR A FINNING MACHINE

[75] Inventor: Robert A. Fusco, Portland, Me.

[73] Assignee: General Electric Company, Schenectady, N.Y.

[21] Appl. No.: 798,091

[22] Filed: May 18, 1977

[51] Int. Cl.[2] ..... B21B 19/12; B21D 37/18

[52] U.S. Cl. ..... 72/43; 72/96; 72/208

[58] Field of Search ..... 72/41, 43, 44, 45, 96, 72/98, 97, 208, 209, 370

[56] References Cited

U.S. PATENT DOCUMENTS

| | | | |
|---|---|---|---|
| 432,463 | 7/1890 | White | 72/96 |
| 2,524,164 | 10/1950 | Dudley et al. | 72/43 |
| 2,726,704 | 12/1955 | Fischer | 72/45 |
| 3,768,291 | 10/1973 | Rieger | 72/96 |

FOREIGN PATENT DOCUMENTS

| | | | |
|---|---|---|---|
| 2,512,654 | 9/1975 | Fed. Rep. of Germany | 72/96 |
| 39-18,344 | 8/1964 | Japan | 72/96 |
| 45-9,058 | 4/1970 | Japan | 72/41 |
| 1,427,513 | 3/1976 | United Kingdom | 72/96 |

*Primary Examiner*—E. M. Combs

*Attorney, Agent, or Firm*—John F. Ahern; James W. Mitchell

[57] ABSTRACT

An improved mandrel is provided for use with a tube-finning machine. The mandrel is mounted to a stationary arbor and supports a tubular member during a tube-finning operation. The mandrel comprises a stationary body axially mounted to the arbor and a lubricated bushing which is rotatably mounted on the body. The bushing facilitates rotation of the tubular member relative to the body and supports the interior surface of the tubular member during the finning operation.

4 Claims, 2 Drawing Figures

LUBRICATED MANDREL FOR A FINNING MACHINE

BACKGROUND OF THE INVENTION

1. Field of the Invention

The present invention relates generally to a mandrel for supporting a tubular workpiece, and more particularly, to such a mandrel for use in a machine which forms heat transfer fins on a tubular member.

2. Description of the Prior Art

The surface areas of various heat transfer components are commonly increased by forming fins on their surfaces. Finned tubular members are used extensively in heat transfer products. For example, one such product in which finned tubular members are employed is a moisture separator-reheater. The most efficient method of finning a tubular member is by roll-forming the surface of the material rather than by cutting away material. A typical apparatus for finning tubular members is the Reed Rolled Thread Die Company Model A23 cylindrical die thread-rolling machine. These machines use three angularly spaced cylindrical dies which rotate in contact with the outer surface of the tubular member and move the material to form fins on the tubular member. The axes of the rotatable dies of the finning machine are slightly skewed to the axis of the tubular member. The rotation of the dies causes the tubular member to rotate, producing helical fins thereon, and to simultaneously feed through the dies.

The pressure of the fin-forming dies could cause the tubular member to distort or collapse. To prevent such distortion a mandrel is commonly employed within the tubular member. Prior to this invention, a mandrel was usually machined from hardened steel and rigidly attached to an arbor. In the process of finning long tubular members up to 60 feet in length, the arbor with rigidly attached mandrel was fixedly mounted to the finning machine. The tubular member rotated on the mandrel and simultaneously slid along the mandrel as the tubular member rotatably fed through the dies. Since the tubular member encountered rotating and sliding frictional forces, the tube-finning process required substantially greater power above that which would be required to process a freely rotating tubular member. It was also found that the heat generated by the rolling and sliding friction of the tube passing over the mandrel caused very short mandrel life, and it was necessary to replace the mandrel several times during each 8-hour work shift.

In another prior art arrangement, the arbor was rotatably mounted to the finning machine. The rotation of the tubular member would cause the arbor with rigidly attached mandrel to rotate with the tubular member. Simultaneously with the mutual rotation, the tubular member would slide along the mandrel. Since the entire arbor with hardened mandrel was rotated with the tubular member, significant additional power was required above that required to rotate the tubular member alone. It was also found that the heat generated by the rolling friction of the arbor and by the friction of the tube passing over the arbor and mandrel caused very short mandrel life. The internal smoothness and diameter of the finned tubular member was found to vary with the wear of the mandrel and it was necessary to replace the mandrel several times during each 8-hour work shift.

By this invention, the disadvantages and limitations of the prior art arrangements are overcome and a mandrel having a lubricated rotatable bushing is provided to facilitate movement of the tubular member during the finning operation. The bushing alone rotates with the tubular member and it is no longer necessary to frictionally rotate the tubular member on the mandrel, or to rotate the entire arbor and mandrel during the finning operation.

Accordingly, a principal object of this invention is to provide a lubricated rotatable mandrel for use with a tube-finning machine, which reduces friction with the tubular member and with mating components to increase the life of the mandrel.

Another object of this invention is to provide a mandrel for use with a tube-finning machine, which reduces the power required to fin the tubular member.

Still another object of this invention is to provide a lubricated rotatable mandrel, for use with a tube-finning machine, which retains a consistent work-supporting surface to thereby consistently maintain the internal smoothness and diameter of the formed tubular members.

SUMMARY OF THE INVENTION

The invention in a preferred embpodiment thereof is directed to an improved mandrel for use with a tube-finning machine. The finning machine includes a plurality of uniformly spaced rotatable dies which rotate and draw a tubular member through the dies while roll-forming helical fins on the tubular member. A stationary arbor is supported within the tubular member on an axis centered in and generally parallel with the axes of the rotatable dies to keep the tubular member from collapsing under the pressure of the dies. The mandrel, mounted to the arbor, extends axially from the arbor and supports the tubular member during the finning operation. The mandrel comprises a stationary mandrel body mounted to the arbor and a lubricated bushing which is rotatably mounted on the mandrel body. The mandrel is longitudinally positioned to align the rotatable bushing with the rotatable dies. The bushing facilitates rotation of the tubular member relative to the mandrel body and supports the interior surface of the tubular member during the finning operation. Lubrication is provided to the bushing surfaces to facilitate rotation of the bushing with the mandrel body. The mandrel body has a central chamber for the lubricant, and has radial passages extending from the chamber to the bushing.

BRIEF DESCRIPTION OF THE DRAWING

While the novel features of the invention are set forth with particularity in the appended claims, the invention will be better understood along with other objects and features thereof from the following detailed description taken in conjunction with the drawing, in which:

DESCRIPTION OF A PREFERRED EMBODIMENT

Figure 1:
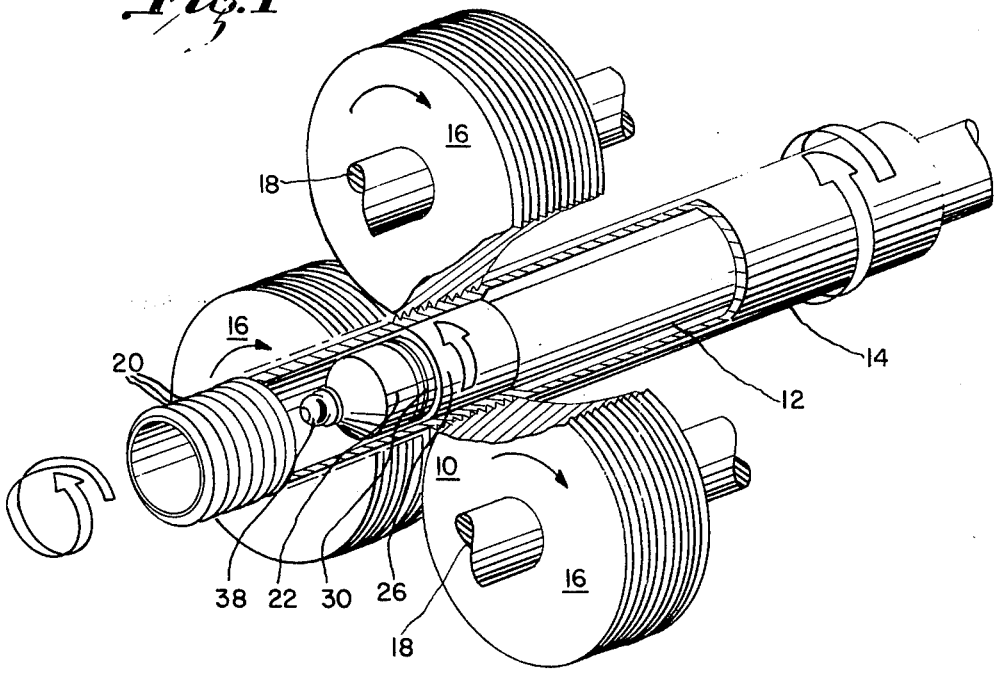
FIG. 1 is a cut-away perspective view of a tubular member supported on the mandrel and supporting arbor during the finning operation.

FIG. 1 illustrates a portion of a finning machine with a mandrel 10 axially mounted to a stationary arbor 12 and supporting a tubular member 14 on which fins to be formed during a tube-finning operation. The arbor 12 is fixedly supported externally of the finning machine to position the mandrel 10 centrally to and generally parallel with the axes of rotatable dies 16. The rotatable dies 16 are shown uniformly angularly spaced about the periphery of tubular member 14. The dies 16 have their axes of rotation 18 slightly skewed to the longitudinal axis of the tubular member 14. The clockwise rotation of the dies 16 in contact with tubular member 14 causes the tubular member to rotate counterclockwise during the finning operation. The skewed axes 18 of the dies 16 cause the rotation of the dies to form external helical fins 20 on the tubular member 14 while also forcing the tubular member to feed along the mandrel and into the dies during the fin-forming operation.

Figure 2:
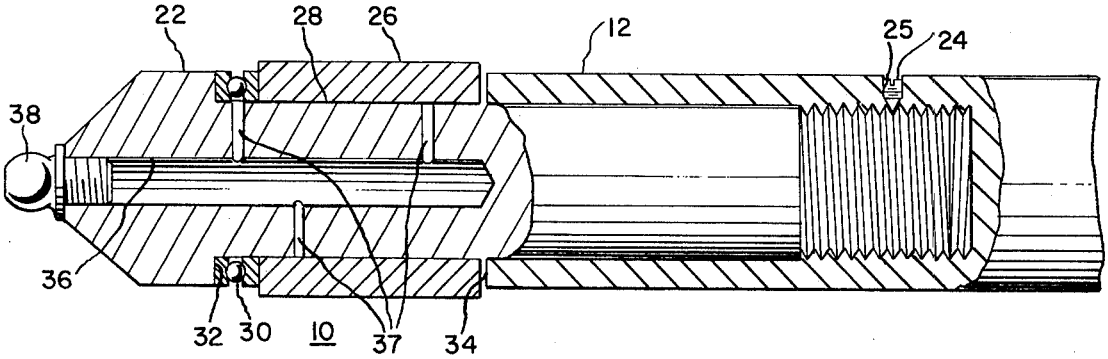
FIG. 2 is an enlarged cross-sectional elevational view of a portion of the structure shown in FIG. 1.

FIG. 2 shows a detailed configuration of the mandrel 10 mounted to the arbor 12. The stationary arbor 12 is generally a steel shaft having one end rigidly supported by the finning machine. The length of the arbor 12 is greater than the length of the tubular member 14 so that the entire tubular member can be pre-positioned on the arbor, and then fed into the dies 16 so that the fins 20 are formed on the entire length of the tubular member in one continuous operation.

The mandrel includes a body 22 which is mounted in threaded engagement with the arbor 12. A set screw 24 is threaded into an aperture 25 in the arbor and engages the mandrel body 22 to secure the mandrel body in position. The mandrel body 22 is preferably made of a material such as steel.

In order to facilitate rotation of the tubular member 14 during the finning operation and to reduce the power required by the machine, the mandrel 10 includes a rotatable tungsten carbide bushing 26. The bushing 26 is rotatably mounted on a reduced shank 28 of the mandrel body 22. The arbor 12 is longitudinally fixed in position so that the bushing 26 of mandrel 10 is centrally aligned with the dies 16. The length of the bushing 26 is somewhat longer than the width of the dies 16. The outer diameter of bushing 26 is larger than any other portion of the mandrel or arbor and corresponds substantially to the inner diameter of tubular member 14. During the finning operation, the bushing 26 is the only element of the mandrel in contact with the tubular member 14. The bushing rotates with the rotating tubular member, and simultaneously the tubular member is forced to slide over the surface of the bushing during the fin-forming operation.

In order to reduce rotational friction losses created by the longitudinal thrust force of the tubular member 14 being forced to slide along the bushing 26, a thrust bearing 30 is interposed between the mandrel body 22 and the bushing. The reduced shank 28 of mandrel body 22 forms an annular shoulder 32 on the mandrel body which is spaced from one end of the bushing 26. The thrust bearing 30 is mounted on the mandrel body with one race against the shoulder 32 and the other race against the end of the bushing 26, and thereby facilitates rotation of the bushing relative to the mandrel body. The longitudinal position of the bushing 26 on the shank of the mandrel body 22 is rotatably fixed between the bearing 30 and the engaged end 34 of the arbor 12.

The frictional forces created by the rotation of bushing 26 on the shank 28 of the mandrel body are reduced by providing lubrication to the contact surfaces. The mandrel body 22 is provided with a longitudinal chamber 36 for a lubricant reservoir. The mandrel body is also provided with a plurality of radial passages 37 extending from the chamber to the bushing contact surface of the shank 28 of the mandrel body. A lubrication fitting 38 is positioned in the end of the chamber 36 of the mandrel body and is adapted to receive a standard lubricant gun. The lubrication of the contact surface facilitates rotation of the bushing on the mandrel body and reduces friction and thereby reduces the temperature of the mandrel during the finning operation. The reduction of the operating temperature significantly extends the performance life of the mandrel. The force required for the tubular member 14 to rotate bushing 26 is substantially less than the force previously required to rotate the tubular member on a stationary mandrel and arbor. The force required for the tubular member to rotate the bushing is significantly less than the force previously required to rotate the entire arbor with fixedly attached mandrel. Therefore, the lubricated mandrel reduces the power required to form fins on the tubular member.

During the finning operation, the force exerted by dies 16 compresses the tubular member 14 against the bushing 26. Since the bushing outer diameter substantially corresponds to the inner diameter of the tubular member, the bushing supports the tubular member and also maintains the desired inner diameter and inner surface smoothness of the tubular member. Friction and heat caused previous mandrels to rapidly wear and erode and this adversely affected the quality of the inner surface of the finned tubular member. The lubricated bushing 26 readily rotates with the tubular member with much less friction and heat and thereby retains the desired consistent supporting surface of the mandrel over a long life. The consistent surface of the mandrel over a long life results in improved quality of the inner surface of the finned tubular member 14 and eliminates the necessity for the frequent replacement of the mandrel.

While specific embodiments of the present invention have been illustrated and described herein, it is realized that modifications and changes will occur to those skilled in the art. It is therefore to be understood that the appended claims are intended to cover all such modifications and changes as fall within the true spirit and scope of the invention.

What is claimed as new and desired to be secured by Letters Patent of the United States is:

1. For use with finning apparatus for rolling fins on a tubular member, said apparatus including spaced rotatable dies which cause rotation of a tubular member during finning operation and a stationary arbor which positions and aligns a tubular member being finned centrally with rotatable dies, a mandrel for rotatably supporting a tubular member being finned, said mandrel comprising:

(a) a stationary mandrel body axially mounted to a fixed arbor;

(b) a cylindrical bushing rotatably mounted on said mandrel body, longitudinally positionable in alignment with said dies, and having an outer diameter larger than the rest of said mandrel and substantially corresponding to the inner diameter of a tubular member being finned; and (c) means for providing lubrication between the contact surfaces of said bushing and said mandrel body to reduce rotational friction losses during rotation of said bushing;

(d) said bushing and said lubricating means facilitating rotation of the tubular member relative to said mandrel body during tube-finning operation without the generation of excessive heat or wear and with the expenditure of a minimum amount of mechanical work.

2. A mandrel as recited in claim 1, wherein said means for providing lubrication between said bushing and said mandrel body, comprises:

a chamber within said mandrel body and extending from an end thereof;

radial passages in said mandrel body extending from said chamber to said bushing; and a lubricant fitting positioned in said chamber at the end thereof and adapted to receive a lubricant gun.

3. A mandrel as recited in claim 2, wherein:

said mandrel body has a shoulder formed thereon, said shoulder being spaced from one end of said bushing; and further including a thrust bearing mounted on said mandrel body between said shoulder and said bushing to facilitate rotation of said bushing relative to said mandrel body.

4. A mandrel as set forth in claim 3 further including a radial passage extending from said chamber to said thrust bearing for providing lubricant to said thrust bearing.

* * * * *